United States Patent [19]

Dalferth

[11] Patent Number: 5,003,872

[45] Date of Patent: Apr. 2, 1991

[54] DEVICE FOR APPLYING COLOR TO A BLOCK OF A TAMPON PRINTING MACHINE

[75] Inventor: G. Robert Dalferth, Ludwigsburg, Fed. Rep. of Germany

[73] Assignee: Morlock Mechanik GmbH

[21] Appl. No.: 370,462

[22] Filed: Jun. 23, 1989

[30] Foreign Application Priority Data

Jun. 23, 1988 [DE] Fed. Rep. of Germany ... 8808059[U]
Jul. 27, 1988 [DE] Fed. Rep. of Germany ... 8809564[U]

[51] Int. Cl.[5] ..... B41F 31/00

[52] U.S. Cl. ..... 101/163; 101/364; 101/DIG. 34

[58] Field of Search ..... 101/163, 167, 169, 119, 101/120, 389.1, DIG. 34, 363, 364

[56] References Cited

U.S. PATENT DOCUMENTS

| | | | |
|---|---|---|---|
| 3,216,349 | 11/1965 | Kraft | 101/120 X |
| 3,448,687 | 6/1969 | Pittenger et al. | 101/363 X |
| 3,831,517 | 8/1974 | Wagner | 101/363 X |
| 4,557,195 | 12/1985 | Philipp | 101/163 |
| 4,854,230 | 8/1989 | Niki et al. | 101/119 X |

*Primary Examiner*—Clifford D. Crowder
*Attorney, Agent, or Firm*—Toren, McGeady & Associates

[57] ABSTRACT

A device for applying color to a block of a tampon printing machine includes a coloring and wiping device which is constructed as a bottomless hollow body and can be moved toward and pressed against the block with a pressing device. The pressing device is at least one magnet arranged in the hollow body. The magnets are arranged in pocket-shaped recesses at the end faces of the square hollow body. It is also possible to provide a stirring mechanism in the hollow body and to arrange the magnets in downwardly open chambers or an annular groove of the stirring mechanism.

21 Claims, 4 Drawing Sheets

DEVICE FOR APPLYING COLOR TO A BLOCK OF A TAMPON PRINTING MACHINE

The invention is directed to a coloring device for tampon printing machines for the application of color to a block. In previously known devices, color is fed to the block via the open base of a hollow body, particularly a cup or the like. The walls of the hollow body are constructed as a doctor blade or wiper. If the hollow body does not firmly contact the block, the latter is smeared and only completely unsatisfactory and blurred impressions are obtained. In order to ensure a tight contact of the hollow body on the block, the contact pressure force of the coloring device on the block is achieved and increased, according to the invention, in that one or more magnets are arranged in the hollow body.

The magnets are advisably fastened in pocket-shaped recesses of the hollow body which protect it from the color medium. Detachable fastenings in the hollow body enable an exchange of the magnets.

In a particularly advisable embodiment form of the invention, the hollow body is constructed so as to be square and the inner chamber is constructed as an elongated triangle in cross section. The pocket-shaped recesses for the magnets are preferably arranged at the front sides of the square hollow body in order to protect them from any contact with the color.

When the coloring cup brushes over the block, a certain quantity of color is picked up again by the cup. A residual amount of color which is wiped off builds up at the outer wall of the cup. During disturbances or work pauses there is the danger that the color will dry particularly on the walls of the cup. It is then often necessary to remove dried on color before putting the printing machine back into operation.

In order to eliminate these problems and construct a hollow body in such a way that hardening of color no longer occurs, the hollow body comprises at least two self-enclosed chambers which open at the bottom, at least one of which is provided with a color feed and color outlet. The division of the hollow body into two chambers makes it possible for an exchange of color to take place in the chamber which comprises both a color feed and a color outlet. A hardening process in the chamber area is accordingly prevented.

The chamber system is advisably designed in such a way that an inner chamber is arranged inside an outer chamber formed by the walls of the hollow body. This arrangement enables a compact construction of the hollow body.

The inner chamber advantageously comprises the color feed and color outlet, wherein the outer chamber comprises at least one color outlet. The inner chamber colors the block and again receives a portion of the color which is wiped off. A residual amount of color remaining on the block is received by the outer chamber.

The arrangement of a color outlet at the outer chamber makes it possible also to guide out this residual amount of color, so that an economical use of the printing color is achieved. According to another feature of the invention, the chamber walls lying transversely relative to the movement direction are constructed as wipers. Accordingly, the quantity of wiper tools is doubled and consequently a cleaner treatment of the block also results.

The color exchange can preferably be achieved in that the color feed and outlets of the chambers are connected with a color reservoir with circulating pump. The circulating pump effects a continuous circulation of the color between the chambers and the color reservoir, so that the color is prevented from drying on. In order to achieve a uniform color consistency, the color reservoir is preferably connected with a container for a color solvent and comprises a mixing device. This has the advantage that a continuous preparation process takes place in the color reservoir. The container for color solvent is advisably arranged in the color reservoir itself and is separated from the portion in the color reservoir provided for the color by means of a wall. A division of the color reservoir into two areas makes an additional container with lines for the color solvent unnecessary. The container for solvent advantageously comprises an annular base on which a hollow cylinder is arranged as an inner wall, wherein the outer wall of the solvent container is the color reservoir itself. The design of the container for the color solvent enables the solvent vapors to precipitate in the color area of the color reservoir. In addition, the hollow cylinder arranged in the center allows a shaft, or the like, to be guided through in order to drive the mixing device and the circulating pump.

The mixing device is preferably constructed as a propeller-like stirring mechanism and is driven via a motor arranged outside the color reservoir. The stirring mechanism thoroughly mixes the solvent vapors with the color medium and, moreover, keeps the color in motion. According to a particularly advisable type of the invention, the circulating pump of the color reservoir is connected with the drive of the mixing device. The color prepared in the stirring mechanism area is pressed through the stirring mechanism into the pump area. The pump area located below is accordingly continuously fed with freshly prepared color. The circulating pump itself supplies the chambers with the fresh color medium. Because of the connection of the stirring mechanism and circulating pump with one shaft, a reciprocal motor can be used.

The color can preferably be additionally prevented from drying on in the interior of the hollow body in that a stirring mechanism is supported in the hollow body so as to be driven in rotation. Because of the rotation of the stirring mechanism, the color is continuously circulated, so that a drying is prevented to a great extent.

The stirring mechanism is preferably arranged on a shaft which is guided out through the hollow body cover and connected with a drive. The drive accordingly remains free of color and an adhesion of same is prevented. According to another feature of the invention, the drive is constructed as a pawl gear unit, wherein a catch wheel is connected with the shaft and the pawls are arranged on a slide which is displaceable in the displacing direction of the hollow body and block, respectively. The slide is advisably connected with the block for the purpose of displacement in the opposite direction. Above all, the slide can be driven by means of a pneumatic lifting cylinder which is controlled in turn by the block.

In order to be able to change the distance between the stirring mechanism and the block, the shaft comprises a threaded part according to another feature of the invention, an adjusting screw supported externally at the hollow body being arranged at the threaded part. The shaft is displaced in an upward or downward direction by means of turning the adjusting nut, wherein an end stop is advisably provided so that the stirring mechanism maintains a minimum distance from the block in order to prevent a smearing of same.

When using a hollow body with stirring mechanism, the magnets are advisably arranged in the latter, wherein the stirring mechanism is provided with one or more chambers for the magnets, which chambers are open at the bottom. A particularly uniform block proof results if one chamber is formed as an annular groove, in which an annular magnet is embedded, the annular groove being provided in the stirring mechanism. The stirring mechanism is preferably constructed as a disk, one or more beaters being arranged at its circumference. The hollow body is advisably provided with a closable filling opening for refilling color or thinning.

The drawing shows embodiment examples of the invention.

Figure 1:
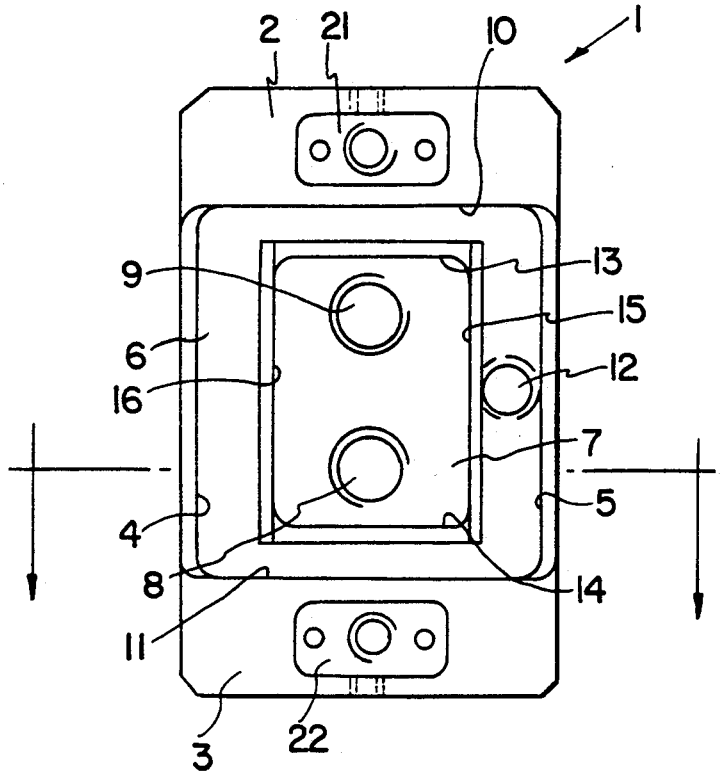
FIG. 1 shows a top view of the hollow body from below.

The hollow body 1 has a substantially square construction, wherein the front walls 2 and 3 and the longitudinal walls 4 and 5 form an elongated rectangle as seen from the top. It comprises two self-enclosed chambers 6 and 7 which are open at the bottom and located one inside the other. The outer chamber 6 is defined by the longitudinal walls 4 and 5 and the inwardly facing surfaces 10 and 11 of the front walls 2 and 3 of the hollow body 1. The outer chamber 2 comprises a color outlet 12. The inner chamber 7 is constructed symmetrically in the outer chamber 6 and is defined by the transverse walls 13 and 14 located opposite one another and, in the same manner, by the longitudinal walls 15 and 16. The inner chamber 7 is likewise constructed as an elongated rectangle and, with its walls, forms the inner walls of the outer chamber 6. It is provided with a color feed 8 and a color outlet 9.

Figure 2:
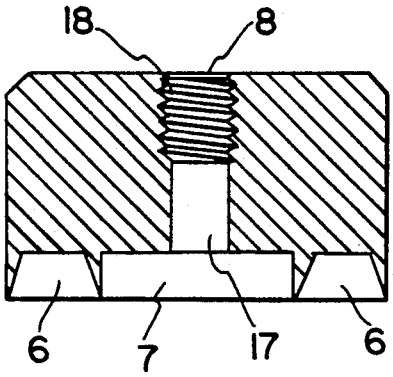
FIG. 2 shows a section corresponding to line 2—2 in FIG. 1.
Figure 3:
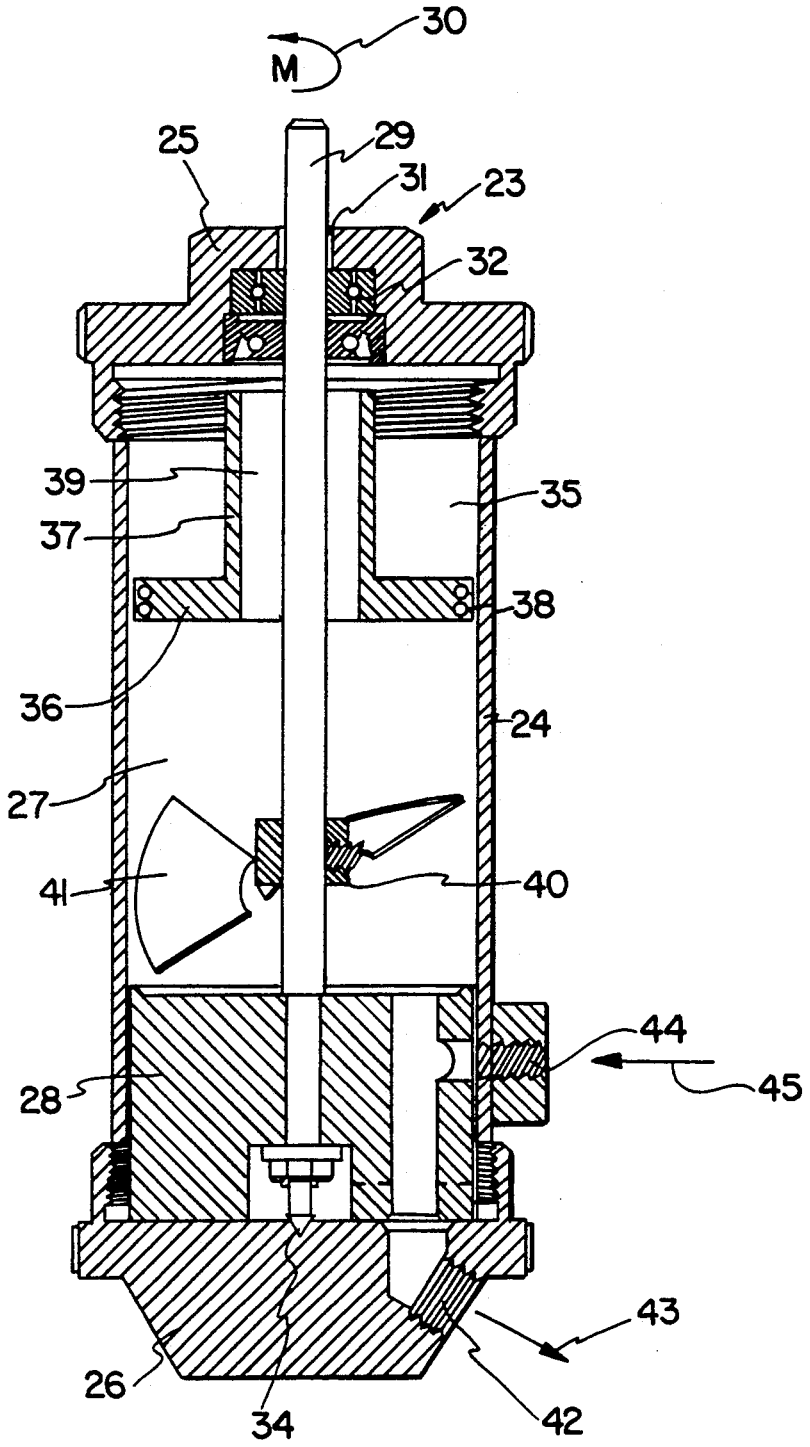
FIG. 3 shows a cross section of the color reservoir.

It can be seen from FIG. 2 that the color feed 8 opens into the inner chamber 7 via a duct 17. The color feed duct 17 comprises a thread 18 in the upper area into which a line, or the like, can be screwed. The color outlet 9 of the inner chamber 7 and the color outlet 12 of the outer chamber 6 are constructed in the same way as the color feed 8. In the use position, the longitudinal walls 4, 5 and 15, 16 of the two chambers 6 and 7 lie on a block, not shown in the drawing, and act as wipers. For this purpose, the free ends of the walls 4, 5, 15, 16 are ground. Pocket-shaped recesses 21 and 22 are arranged in the two front walls 2 and 3 of the hollow body 1, the openings of the pocket-shaped recesses 21 and 22 likewise face toward the base of the hollow body 1. Magnets, which are not shown in the drawing, are clamped in the latter by means of screws.

The color reservoir 23 has a cylindrical shape, wherein the hollow cylinder 24 is closed at the upper end by means of a cover 25 and at the lower end by means of a base 26. A mixing device 27 and a circulating pump 28 located below the latter are arranged in the lower area of the hollow cylinder 24. The mixing device 27 and the circulating pump 28 are driven in the direction of the arrow 30 by means of a motor, not shown in the drawing, via a supported shaft 29. The shaft 29 is guided through an opening 31 in the cover 25. The shaft 29 is rotatably supported in a bearing 32 which is arranged in the cover 25.

The free end of the shaft 29 engages in a bearing pin 34 which is arranged in the base 26 of the color reservoir 23. A container for solvent 35 is arranged in the upper area of the color reservoir 23. The container for solvent 35, whose base 36 has an annular shape and on which a hollow cylinder 37 is arranged as inner wall, is held by means of 0-rings 38 in the hollow cylinder 24 of the color reservoir 23. The container for solvent 35 is directly connected with the mixing device 27 by means of the duct-like opening of the hollow cylinder 39.

The shaft 29 is guided centrically through the duct 39 of the container for solvent 35. A propeller-like stirring mechanism 40 is arranged on the shaft 29 in the area of the mixing device 27. The beater surfaces 41 of the propeller-like stirring mechanism 40 thoroughly mix the color medium, not shown in the drawing, with the solvent vapors which rise out of the container for solvent 35 and then precipitate in the color container. The circulating pump 28, which is likewise driven via the shaft 29, is located below the mixing device 27. The base 26 of the color reservoir 23 comprises an opening 42 which can receive a connection, or the like, via a thread. It can be seen in the direction of arrow 43 that the color feed 8 of the hollow body 1 is connected to the opening 42 in the base 26 of the color reservoir 23 via lines, not shown. Another lateral opening 44 is arranged in the wall of the hollow cylinder 24 in the area of the circulating pump 28. In the direction of arrow 45, the color outlet 9 of the inner chamber 7 and the color outlet 12 of the outer chamber 6 are likewise connected via lines, not shown, to the lateral opening 44. The circulating pump 28 sucks in the color medium again via the opening 44.

A continuous color exchange takes place via the lines between the chambers 6 and 7 of the hollow body 1 and the color reservoir 23. The color prepared in the mixing device 27 is pressed into the hollow body by means of the circulating pump 28. The wiped off color of the chambers 6 and 7 not remaining on the block is then sucked off again by the circulating pump 28 and fed to the mixing device 27 for preparation. The stirring mechanism 40 of the mixing device 27 keeps the color medium in motion in the meantime and thoroughly mixes it with the solvent vapors which precipitate out of the container for solvent 35 in the area of the mixing device 27.

Figure 4:
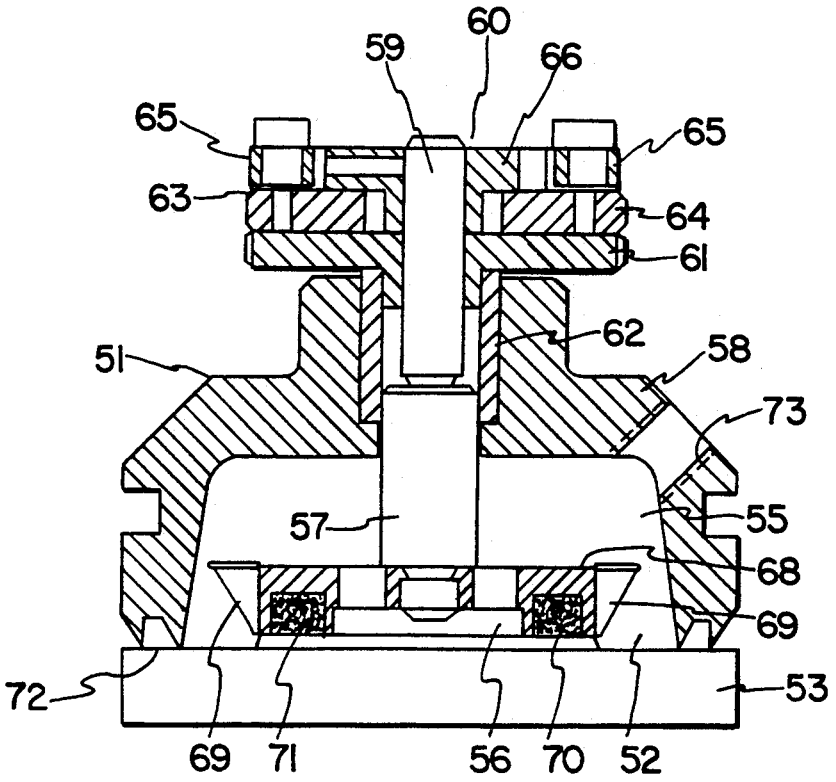
FIG. 4 shows a cross section through a coloring and wiping device, with block, of another embodiment form.
Figure 5:
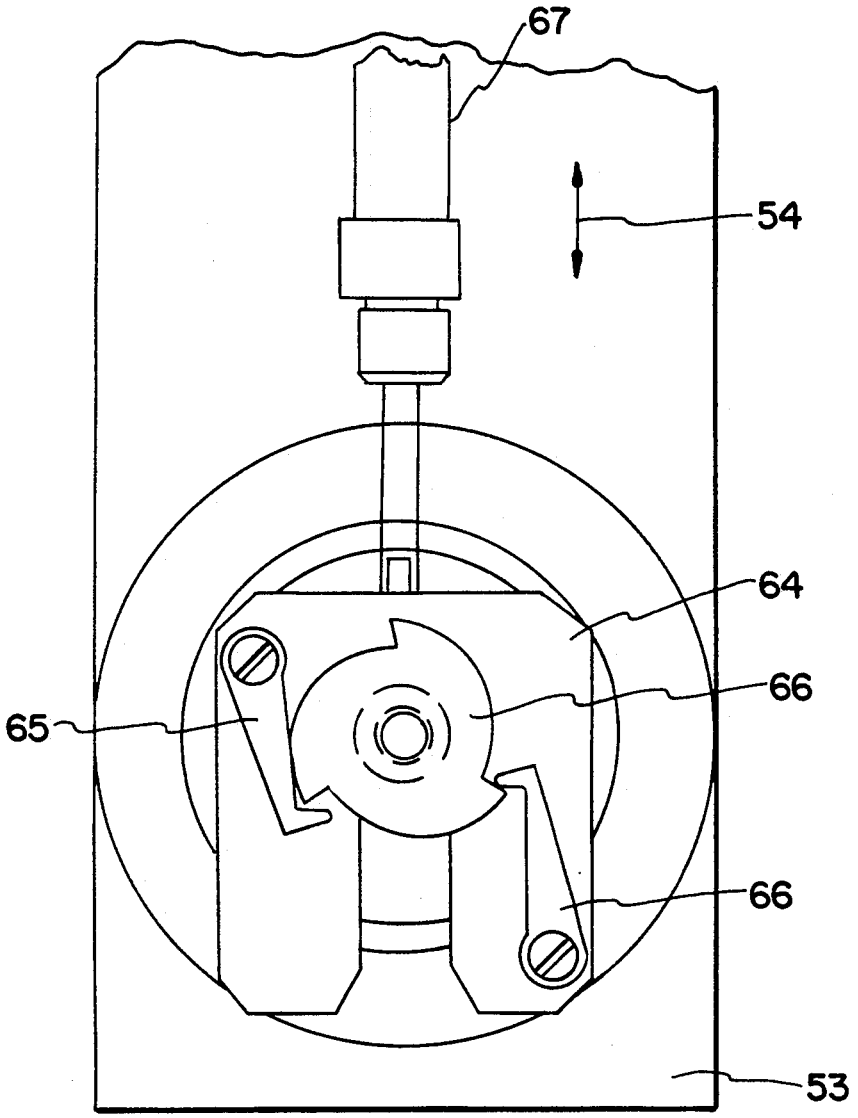
FIG. 5 shows a truncated top view according to FIG. 4.

In the embodiment example according to FIGS. 4 and 5, the coloring and wiping device is likewise fashioned as a bottomless hollow body 51 and contacts a block 53 with its open side 52. This block is displaceable in a reciprocating manner relative to the hollow body 1 in arrow direction 54. In order to prevent a drying of the color, not shown, in the interior 55 of the hollow body 51, a stirring mechanism 56 is rotatably supported on a shaft 57. The shaft 57 is guided through the cover 58 of the hollow body 51 and is provided with a thread 60 at its upper end 59. An adjusting nut 61 is arranged on the thread 60 and is supported in turn at the hollow body 51 and the bearing bush 62 of same. The stirring mechanism 56 can be displaced in an upward or downward direction by means of turning the adjusting nut 61, wherein a stop, not shown, ensures that a minimum distance always remains between the stirring mechanism 56 and the block 53.

A pawl gear unit 63 which (FIG. 5) comprises a slide 64 with the pawls 65 and a catch wheel 66 connected with the shaft 57 is arranged after the upper end of the shaft 57. The block 53 is movable in a reciprocating manner in arrow direction 54 relative to the hollow body and the slide 64 can also be displaced in the same direction. This is effected via a pneumatic lifting cylinder 67 which is controlled by the block 53 in such a way that the movements are effected in the opposite direction. The stirring mechanism 56 is rotated by 120° during every lift of the cylinder 67. The color, not shown, is circulated by means of this rotation and is prevented from drying. An electric motor, for example, which is not shown, can also by used as a drive in place of the pawl gear unit 63.

The stirring mechanism 56 is constructed as a disk 68 and provided with a plurality of mixing beaters 69 at the outer circumference. Moreover, a chamber in the form of an annular groove 70 is provided which is open toward the block 53 and in which an annular magnet 71 is arranged. This serves to press the lower edge 72 of the hollow body 51 uniformly against the block 53, the lower edge 72 of the hollow body 51 being constructed as a wiper. A closable filling opening 73 is also arranged in the hollow body 51 for refilling with color or thinning.

I claim:

1. In a device for applying color to a block of a tampon printing machine comprising a coloring and wiping device which includes a bottomless hollow body (51), the hollow body (51) having an open side, the hollow body (51) adapted to be movable relative to the block and to be placed with the open side on the block and pressable against the block by means of a pressing device, the improvement comprising a stirring mechanism (56) being rotatably arranged in the hollow body (51), the pressing device comprising at least one magnet, the stirring mechanism (56) having at least one downwardly open chamber (70), the at least one magnet being mounted in the downwardly open chamber.

2. Device according to claim 1, characterized in that the hollow body has a body cover (58) and the stirring mechanism (56) is arranged on a shaft (57) which is guided outward through the hollow body cover (58) and connected there with a drive (63).

3. Device according to claim 2, characterized in that the drive (63) is constructed as a pawl gear unit (64, 65, 66) including pawls (65), wherein a catch wheel (66) is connected with the shaft (57) and the pawls (65) are arranged on a slide (64) which is displaceable in a displacing direction (54) of the hollow body (51) and the block (53), respectively.

4. Device according to claim 3, characterized in that the slide (64) is connected with the block (53) for the purpose of displacement in the opposite direction.

5. Device according to claim 4, characterized in that the slide (64) is driven by means of a pneumatic lifting cylinder (67) which is controlled by the block (53).

6. Device according to claim 2, characterized in that the hollow body (51) has an outer surface and the shaft (57) comprises a threaded part (59), on which is arranged an adjusting nut (61) which is supported externally at the hollow body (51).

7. Device according to claim 1, wherein the at least one magnet (71) is annular and is arranged in an annular groove (70) forming the at least one chamber.

8. Device according to claim 1, characterized in that the stirring mechanism (56) is constructed as a disk (68), one or more beaters (69) being arranged at an outer circumference of the disk (68).

9. Device according to claim 1, characterized in that the hollow body (51) is provided with a closable filling opening (73) for color or thinning.

10. In a device for applying color to a block of a tampon printing machine comprising a coloring and wiping device which includes a bottomless hollow body (1), the hollow body (1) having an open side, the hollow body (1) being adapted to be movable relative to the block and to be placed with its open side on the block and to be pressable against the block by means of a pressing device, the hollow body having end faces facing the block, the improvement comprising pocket-shaped recesses in the end faces of the hollow body (1), at least one magnet being detachably mounted in the pocket-shaped recesses, wherein the hollow body (1) is square in shape.

11. Device according to claim 10, characterized in that the hollow body (1) comprises at least two self-enclosed chambers (6, 7) which open downward, at least one chamber (6, 7) being provided with a color feed (8) and outlet (9).

12. Device according to claim 11, characterized in that an inner chamber (7) is arranged inside an outer chamber (6) formed by the walls of the hollow body (1).

13. Device according to claim 12, characterized in that the inner chamber (7) comprises at least one color feed (8) and color outlet (9), and the outer chamber comprises at least one color outlet (12).

14. Device according to claim 13, characterized in that the color feed (8) and color outlets (9, 12) of the chambers (6, 7) of the hollow body (1) are connected with a color reservoir (23) with circulating pump (28).

15. Device according to claim 14, characterized in that the color reservoir (23) is connected with a container for a color solvent (35) and comprises a mixing device (27).

16. Device according to claim 15, characterized in that the container for the color solvent (35) is arranged in the color reservoir (23) itself and is separated by means of a wall (36, 37) from the portion in the reservoir provided for the color.

17. Device according to claim 16, characterized in that the container for the solvent (35) comprises an annular base (36) on which a hollow cylinder (37) is arranged as an inner wall, wherein the outer wall of the solvent container (35) is the color reservoir (23) itself.

18. Device according to claim 17, characterized in that the mixing device (27) is constructed as a propeller-like stirring mechanism (40) and can be driven by means of a motor arranged outside the color reservoir (23).

19. Device according to claim 14, characterized in that the circulating pump (28) of the color reservoir (23) is connected with the drive of the mixing device (27).

20. Device according to claim 12 wherein, the inner chamber (7) is constructed as an elongated rectangle in cross section.

21. Device according to claim 11, characterized in that the chambers have walls (4, 5, 15, 16) lying transversely relative to the movement direction and are constructed as wipers.

* * * * *